US008851287B2

(12) United States Patent
Becklin

(10) Patent No.: US 8,851,287 B2
(45) Date of Patent: Oct. 7, 2014

(54) CONTAINER STACKING SYSTEM WITH UNIVERSAL MEMBERS

(75) Inventor: Dennis M. Becklin, Grants Pass, OR (US)

(73) Assignee: Becklin Holdings, Inc., Reno, NV (US)

( * ) Notice: Subject to any disclaimer, the term of this patent is extended or adjusted under 35 U.S.C. 154(b) by 919 days.

(21) Appl. No.: 12/395,440

(22) Filed: Feb. 27, 2009

(65) Prior Publication Data

US 2010/0219193 A1 Sep. 2, 2010

(51) Int. Cl.
*B65D 21/02* (2006.01)
*B65D 21/032* (2006.01)
*B65D 19/38* (2006.01)

(52) U.S. Cl.
CPC ..... *B65D 21/0224* (2013.01)
USPC ..... 206/501; 206/509; 206/511; 108/12; 108/53.1; 108/55.3; 108/57.33

(58) Field of Classification Search
USPC ..... 108/12, 53.1, 55.3, 57.33, 901; 206/501, 509, 511
See application file for complete search history.

(56) References Cited

U.S. PATENT DOCUMENTS

| | | | | |
|---|---|---|---|---|
| 879,455 | A | | 2/1908 | Frost |
| 2,695,115 | A | | 11/1954 | Roop |
| 2,849,151 | A | | 8/1958 | Heil |
| 3,103,278 | A | | 9/1963 | Kuzma et al. |
| 3,117,692 | A | | 1/1964 | Carpenter et al. |
| 3,383,009 | A | | 5/1968 | Weikert |
| 3,391,824 | A | | 7/1968 | Wiseman |
| 3,407,758 | A | * | 10/1968 | Simkins ..... 108/51.3 |
| 3,419,184 | A | | 12/1968 | Asenbauer |
| 3,481,502 | A | | 12/1969 | Slayman |
| 3,616,943 | A | | 11/1971 | Brink |
| 3,754,645 | A | | 8/1973 | Kilroy |
| 3,756,396 | A | | 9/1973 | Kilroy |
| 3,759,416 | A | | 9/1973 | Constantine |
| 3,811,747 | A | | 5/1974 | Levin |
| D236,326 | S | * | 8/1975 | Trebilcock ..... D9/456 |
| 3,916,803 | A | * | 11/1975 | Garcia ..... 108/57.28 |
| 3,926,321 | A | * | 12/1975 | Trebilcock ..... 206/446 |
| 3,968,879 | A | | 7/1976 | Lucas, Sr. et al. |
| 4,287,997 | A | | 9/1981 | Rolfe et al. |
| 4,618,059 | A | * | 10/1986 | Cochran ..... 206/392 |
| 4,655,360 | A | | 4/1987 | Juhanson |
| 4,765,252 | A | | 8/1988 | Shuert |
| 4,832,200 | A | | 5/1989 | Deaton et al. |
| 4,848,605 | A | | 7/1989 | Wise |
| 4,889,235 | A | * | 12/1989 | Hess ..... 206/511 |
| 5,054,617 | A | * | 10/1991 | Young et al. ..... 206/509 |
| D333,094 | S | | 2/1993 | Zutler |
| 5,203,494 | A | | 4/1993 | Blomfield |

(Continued)

FOREIGN PATENT DOCUMENTS

EP 0129860 1/1985

*Primary Examiner* — Fenn Matthew
*Assistant Examiner* — Jennifer Castriotta
(74) *Attorney, Agent, or Firm* — Lowe Graham Jones PLLC

(57) ABSTRACT

Universal members placed between containers having different stacking patterns permit stacking of these containers regardless of the type of container positioned as the bottom container. The universal members include an appropriate thickness and a plurality of openings configured to receive the different stacking patterns. Depending on the containers being stacked, the universal members may take different forms. For example, one universal member may include T-shaped openings while another universal member may include rectangular-shaped openings with offset members.

6 Claims, 7 Drawing Sheets

(56) References Cited

U.S. PATENT DOCUMENTS

| | | | | |
|---|---|---|---|---|
| 5,392,945 | A | 2/1995 | Syrek | |
| 5,404,829 | A * | 4/1995 | Shuert | 108/57.26 |
| D361,715 | S | 8/1995 | Haupert | |
| 5,454,477 | A | 10/1995 | Bornhorst et al. | |
| 5,641,090 | A | 6/1997 | Kowalski et al. | |
| 5,718,350 | A | 2/1998 | Williams | |
| 5,769,230 | A | 6/1998 | Koefelda | |
| 5,779,051 | A | 7/1998 | Boutin | |
| 5,974,981 | A * | 11/1999 | Ditton | 108/55.3 |
| 6,021,916 | A | 2/2000 | Stolzman | |
| 6,085,467 | A | 7/2000 | Packrall et al. | |
| 6,186,345 | B1 | 2/2001 | Robertson | |
| 6,237,758 | B1 | 5/2001 | Hsu | |
| D446,017 | S | 8/2001 | Koefelda | |
| 6,308,858 | B1 | 10/2001 | Koefelda | |
| 6,371,364 | B1 | 4/2002 | Maillot et al. | |
| 6,446,563 | B1 * | 9/2002 | Ohanesian | 108/57.25 |
| 6,457,599 | B1 | 10/2002 | Apps et al. | |
| 6,585,090 | B2 | 7/2003 | Harvey | |
| 6,622,642 | B2 * | 9/2003 | Ohanesian | 108/57.25 |
| 6,662,950 | B1 | 12/2003 | Cleaver | |
| 6,698,362 | B2 * | 3/2004 | Crevillen Pastor | 108/51.3 |
| D500,924 | S | 1/2005 | Martin et al. | |
| 7,163,122 | B2 | 1/2007 | Elder et al. | |
| 2004/0134390 | A1 * | 7/2004 | Apps et al. | 108/53.1 |
| 2004/0178208 | A1 | 9/2004 | Leba et al. | |
| 2006/0254946 | A1 * | 11/2006 | Becklin | 206/508 |
| 2006/0254947 | A1 | 11/2006 | Rogers | |
| 2008/0017650 | A1 * | 1/2008 | Evans et al. | 220/507 |
| 2010/0219193 | A1 * | 9/2010 | Becklin | 220/630 |

* cited by examiner

CONTAINER STACKING SYSTEM WITH UNIVERSAL MEMBERS

FIELD OF THE INVENTION

This invention relates to a container stacking system for containers having different stacking patterns, and more specifically relates to a container stacking system having universal members that engage the different stacking patterns.

BACKGROUND OF THE INVENTION

Various types of containers, which may take the form of transit containers, rack-mount containers, tote containers or another type of container, are often utilized to receive and support delicate cargo, such as, but not limited to electronic, computer, optical and other types of equipment. These containers are often used in military and commercial environments and may be handled by persons, loading equipment, or both during transit and at other times. At least some of these containers have been designed to be stackable, and thus they include stacking elements or features arranged in a desired pattern. However, many of these containers may be of different types, sizes, models and versions, which in turn may be configured with different stacking patterns that either do not permit the containers to be stacked one on top of another or that reduce the effectiveness, stability and/or efficiency of the containers when they are stacked together. By way of example, one company that manufactures containers having different stacking patterns is ECS Composites, Inc. out of Grants Pass, Oreg.

A variety of containers with stackability patterns include, but are not necessarily limited to, the following containers described in U.S. Pat. No. 6,457,599 to Apps et al.; U.S. Pat. No. 6,237,758 to Hsu; U.S. Pat. No. 6,186,345 to Robertson; U.S. Pat. No. 6,085,467 to Packrall et al.; U.S. Pat. No. 5,769,230 to Koefelda; U.S. Pat. No. 5,203,494 to Blomfield; and U.S. Pat. No. 4,655,360 to Juhanson.

SUMMARY OF THE INVENTION

Containers, such as transit containers, rack-mount containers, tote containers or other types of containers often include stacking patterns located on some portion of the container, for example the top and bottom surface or on the lid surfaces. Regardless, this stackability makes the containers more space efficient and easier to maneuver, especially in a field environment. As the containers evolve over time, sometimes it is either desired or necessary to modify the stacking pattern. However, users of the containers may still desire to stack containers having an older-style stacking pattern with containers having a newer-style stacking pattern, or vice-versa. Alternatively, the users may desire to stack containers that were simply designed with two different types of stacking patterns. Thus, in one embodiment, a universal member includes a thickness and a plurality of openings that are configured to permit stacking of containers having different stacking patterns.

In one example of the invention, a universal member includes a first side and a second side defining a thickness. The first side is configured with a first stacking pattern arranged to receivably engage stacking protrusions extending from a stacking surface of a lower container. The second side is configured with a second stacking pattern arranged to receivably engage stacking protrusions extending from a stacking surface of an upper container. And, the first and second stacking patterns permit the upper container to be stacked on the lower container when the universal member is positioned in a selected location between the containers.

In another example of the invention, a container stacking system for stacking containers includes a first stackable container having a first stacking pattern extending from both an upward facing surface and a downward facing surface of the first stackable container; a second stackable container having a second stacking pattern extending from both an upward facing surface and a downward facing surface of the second stackable container; a third stackable container having the first stacking pattern extending from both an upward facing surface and a downward facing surface of the third stackable container; a first universal member located between the first and second stackable containers when the first and second stackable containers are in a stacked configuration, the first universal member having a first arrangement of openings configured to receive at least a portion of the first stacking pattern and at least a portion of the second stacking pattern; and a second universal member located between the second and third stackable containers when the second and third stackable containers are in a stacked configuration, the second universal member having a second arrangement of openings configured to receive at least a portion of the second stacking pattern and at least a portion of the third stacking pattern.

In yet another example of the invention, a method for stacking containers includes the steps of (1) placing a first stackable container on a surface, the first stackable container having a first stacking pattern extending from an upward facing surface; (2) placing a universal member onto the first stackable container, the universal member having a plurality of openings configured to receive at least a portion of the first stacking pattern; and (3) placing a second stackable container onto the first stackable container with the universal member located there between, the second stackable container having a second stacking pattern extending from a downward facing surface, wherein the plurality of openings in the universal member are further configured to receive at least a portion of the second stacking pattern.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

In an example of the present invention, universal members having an appropriate thickness and a plurality of openings are configured to permit stacking of containers having different stacking patterns. Depending on the containers being stacked, the universal member may take different forms. For example, one universal member may include T-shaped openings while another universal member may include rectangular-shaped openings with divider plates, as will be explained in greater detail below. Selected universal members may be placed between selected containers to permit stacking of the containers.

Figure 1:
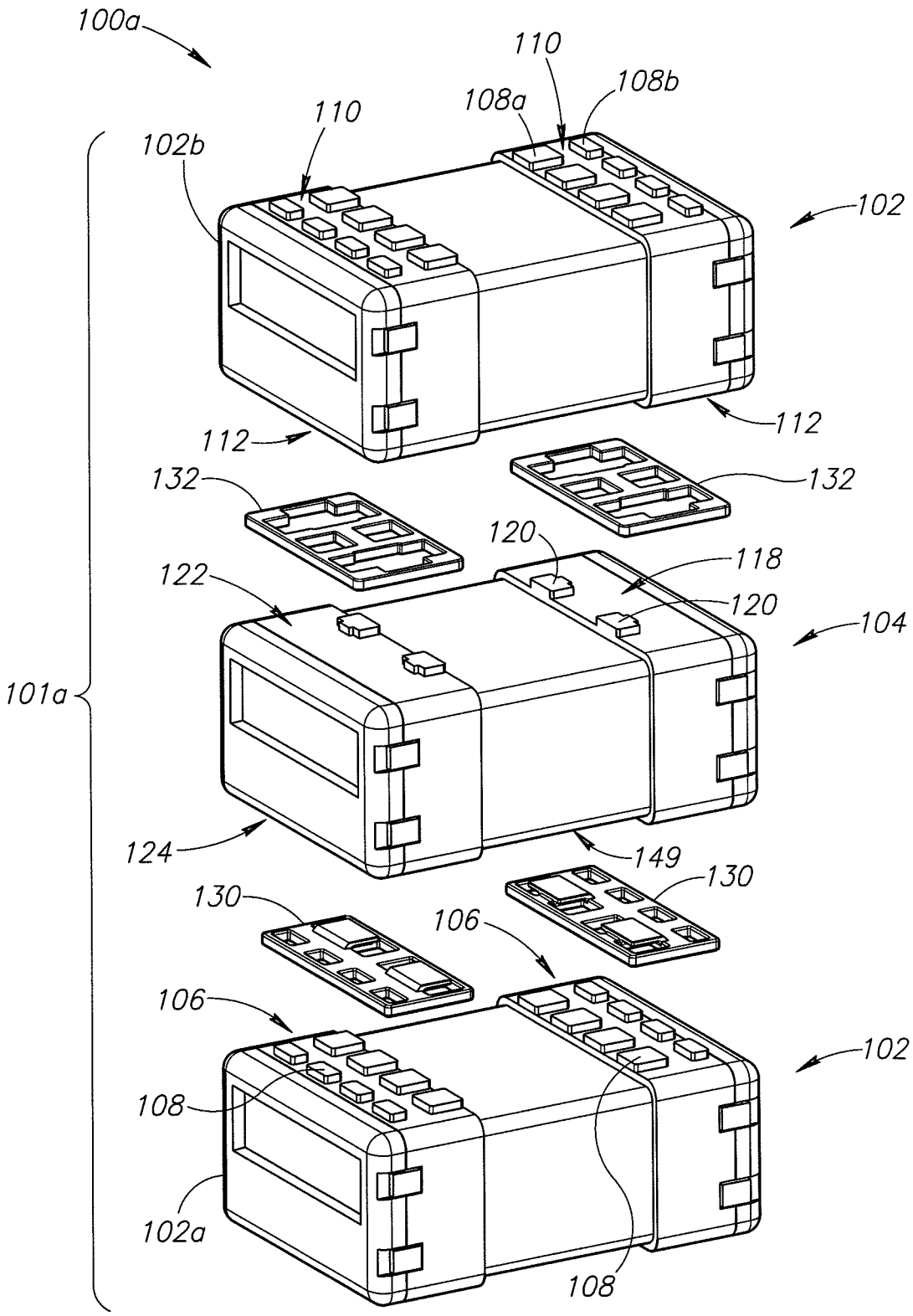
FIG. 1 shows an exploded perspective view of a container stacking system with at least two types of containers having different stacking patterns and further having universal members located between the containers to permit stacking thereof according to an embodiment of the present invention.

FIG. 1 shows a container stacking system 100*a* in a first stacked configuration 101*a*, The container stacking system 100*a* includes a first-style container 102 and a second-style container 104. In the illustrated embodiment, the first-style containers comprise the top and bottom containers 102*a*, 102*b*, respectively, while the second-style container 104 is the middle container 104. The first-style containers 102*a*, 102*b* are identical for purposes of the present description; therefore the present description herein will focus primarily on the bottom container 102*a*.

Figure 2:
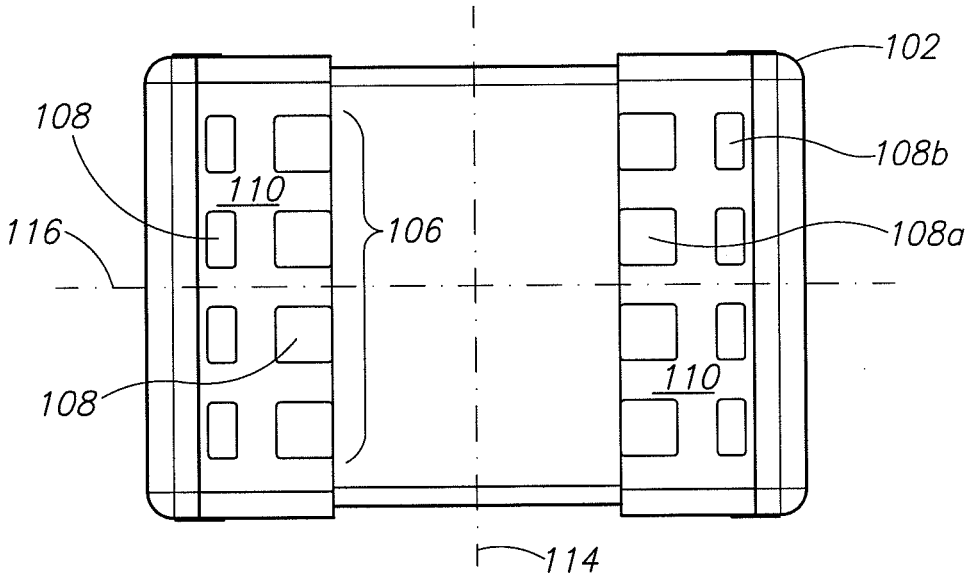
FIG. 2 shows a top plan view of a first-style container having a first stacking pattern.

Referring to FIG. 2 and still to FIG. 1, the first-style container 102 includes a first stacking pattern 106 having a plurality of protuberances 108, which may take the form of protrusions, elements, features, bosses, etc. The protuberances 108 are located on upward and downward facing surfaces 110, 112 of the first-style container 102, as best shown on the upper container 102*b* in FIG. 1 and in FIG. 2. The stacking pattern 106 may take a variety of forms and as such, the illustrated embodiment provides merely one example of how the protuberances 108 may be arranged to form the stacking pattern 106. Generally, the protuberances 108 are arranged in respective rows, columns or both. In the illustrated embodiment, the protuberances 108 are arranged as a row of square-shaped protuberances 108*a* adjacent to a row of smaller, rectangular-shaped protuberances 108*b*, In addition, the protuberances 108 may be arranged symmetrically about axes 114, 116, respectively.

Figure 3:
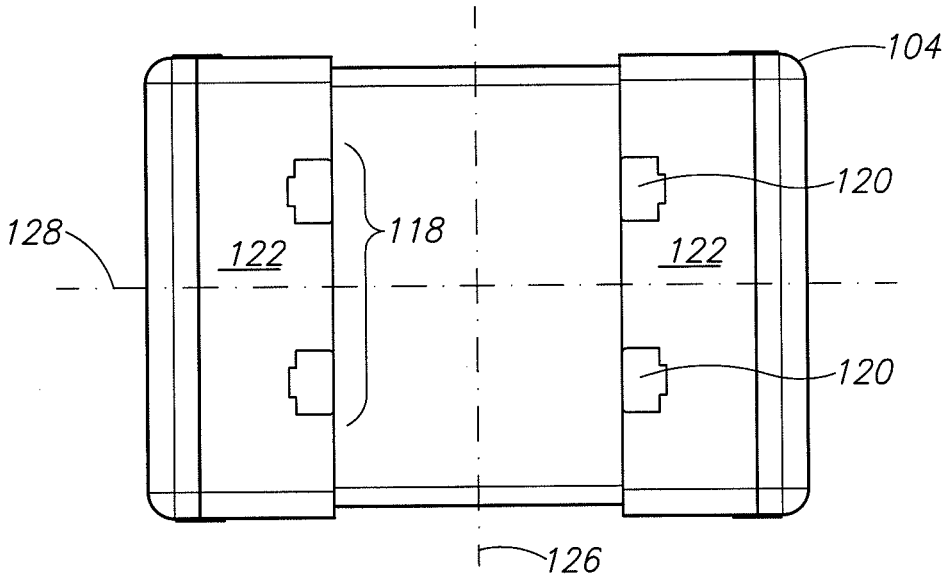
FIG. 3 shows a top plan view of a second-style container having a second stacking pattern.

Now referring to FIG. 3 and still to FIG. 1, the second-style or middle container 104 includes a second stacking pattern 118 having a plurality of protuberances 120, which again may take the form of protrusions, elements, features, bosses, etc. The protuberances 118 are located on upward and downward facing surfaces 122, 124 of the middle container 104. Similar to the first stacking pattern, the second stacking pattern 118 may take a variety of forms and as such, the illustrated embodiment provides merely one example of how the protuberances 120 may be arranged to form the stacking pattern 118. In the illustrated embodiment, the protuberances 120 are arranged as a pair of two T-shaped protuberances. In addition, the protuberances 120 may be arranged symmetrically about axes 126, 128, respectively. Preferably, the stacking patterns 106, 118, for each container 102, 104, are molded integrally with the container; however they may be applied independently using a mechanical fastening process such as, but not limited to fastening with bolts or screws or by applying a bonding agent.

Referring back to FIG. 1, the containers 102, 104 are arranged in the stacked configuration 101*a* through employment of universal members 130, 132. The universal member 130 is configured to receive the first stacking pattern 106 of the container 102*a* and also receive the second stacking pattern 118 of the container 104, when the container 104 is stacked on top of the container 102*a*, Likewise, the universal member 132 is configured to receive the second stacking pattern 118 of the container 104 and also receive the first stacking pattern 106 of the container 102*b*, when the container 102*b* is stacked on top of the container 104.

Figure 4:
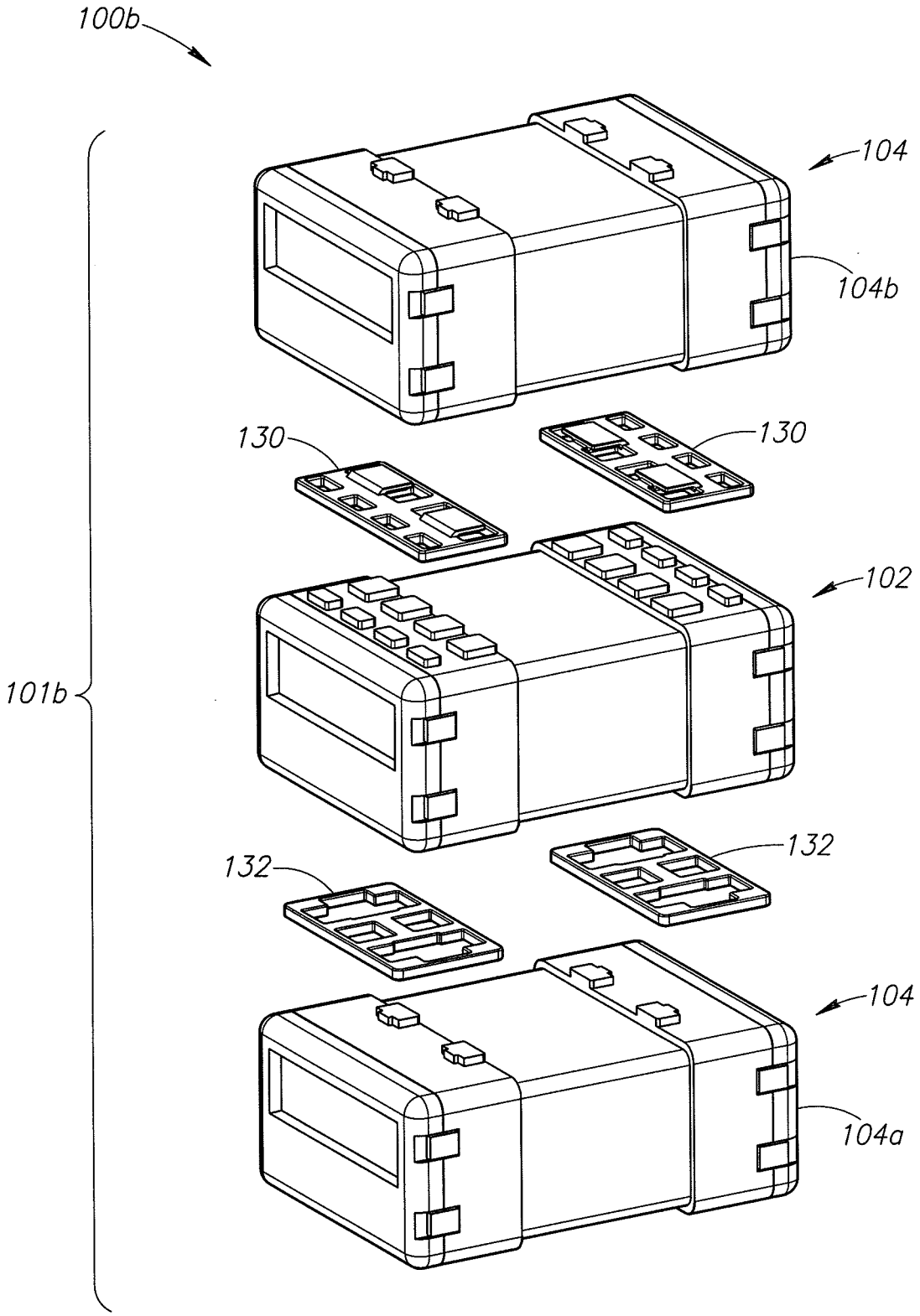
FIG. 4 shows an exploded perspective view of another container stacking system with at least two types of containers having different stacking patterns and further having universal members located between the containers to permit stacking thereof according to an embodiment of the present invention.

FIG. 4 shows the containers 102, 104 arranged in another stacked configuration 101*b* through employment of the universal members 130, 132. In the stacked configuration 101*b*, two second-style containers 104*a*, 104*b* are arranged as the bottom and top containers while one first-style container 102 is arranged as the middle container. Because of this stacked configuration 101*b*, the universal member 132 is placed on the bottom container 104*a* and the universal member 130 is placed on the middle container 102. Thus, depending on which order the first-style and second-style containers 102, 104 are being stacked determines which universal member 130 or 132 is to be placed on the lower or bottom container.

Figure 5A:
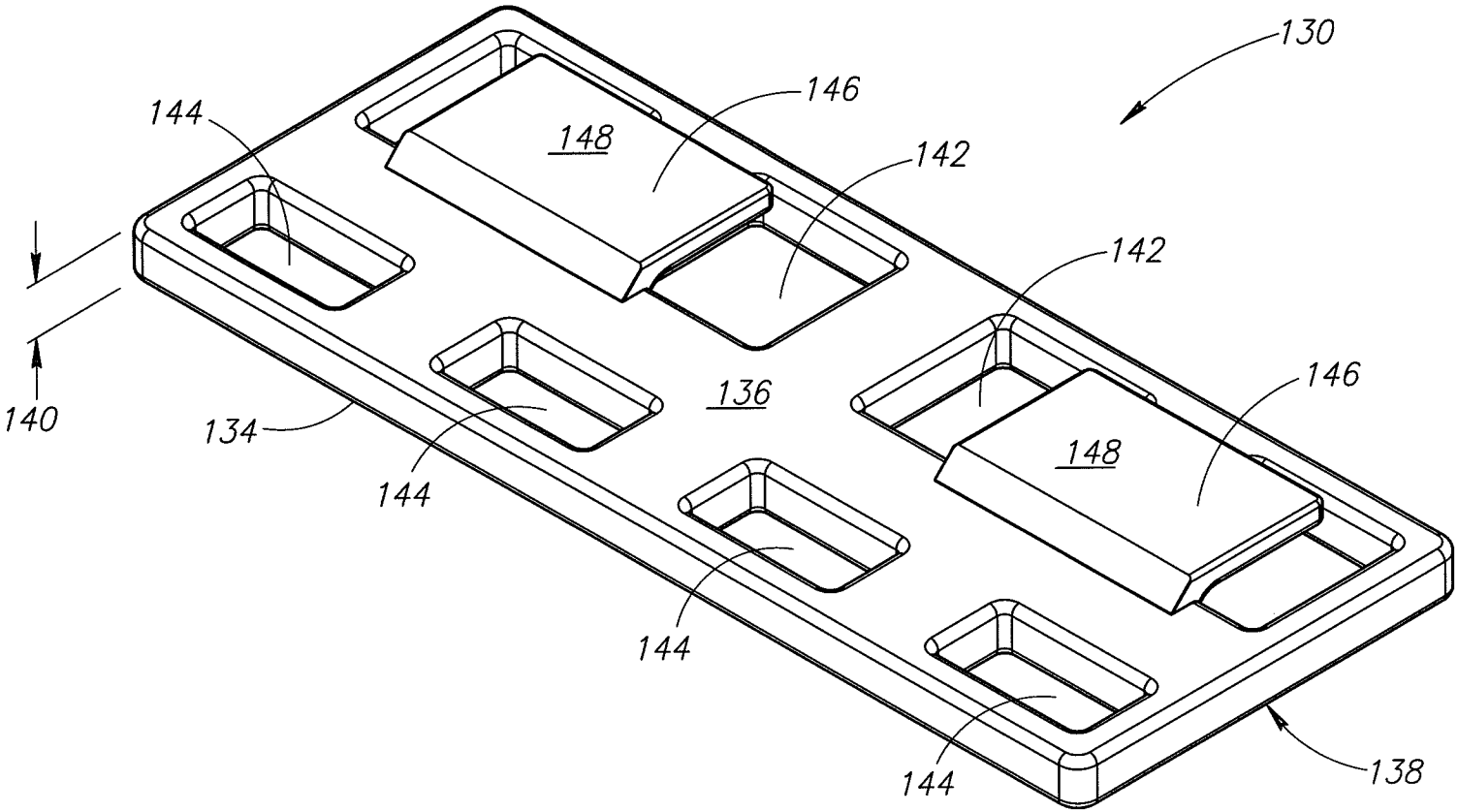
FIG. 5A shows a first perspective view of a first side of a first universal member according to an embodiment of the present invention.
Figure 5B:
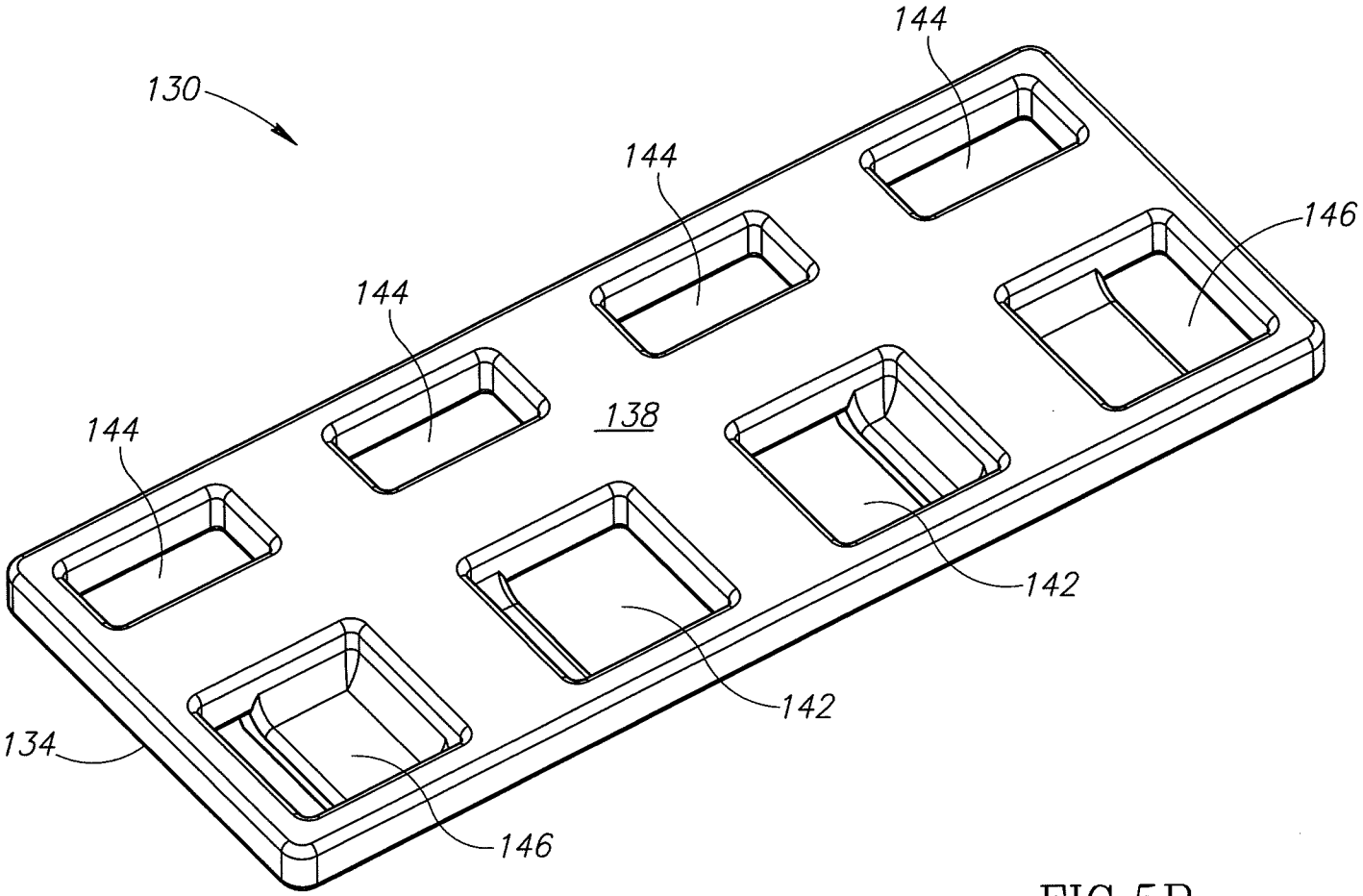
FIG. 5B shows a second perspective view of an opposite side of the first universal member of FIG. 5A.

FIGS. 5A and 5B show the universal member 130 having the form of a plate 134 with a top side 136 and a bottom side 138 defining a thickness 140. The universal member 130 includes first openings 142 and second openings 144 arranged to complementarily receive the stacking patterns 106, 118 of the containers 102, 104, respectively. More specifically, the first openings 142 take the form of two rectangular-shaped openings having an offset member 146 coupled to the plate 134 to close off a portion of the first openings 142 and the second openings 144 take the form of smaller-sized rectangular-shaped openings substantially aligned along their long axis.

Referring also back to FIGS. 1 and 2, the arrangement of the openings 142, 144 in cooperation with the thickness 140 provides a complementary stacking pattern for receiving the protuberances 108 of the container 102*a*, In addition, the offset member 146 is configured to receive the protuberances 120 of the container 104 when a surface 148 (FIG. 5) of the offset member 146 is placed on a corresponding surface 149 (FIG. 1) of the container 104. By way of example, if the thickness of each protuberance 108 is 0.40 inches then it follows that the thickness 140 of the universal member 130 is at least greater than 0.40 inches.

Figure 5C:
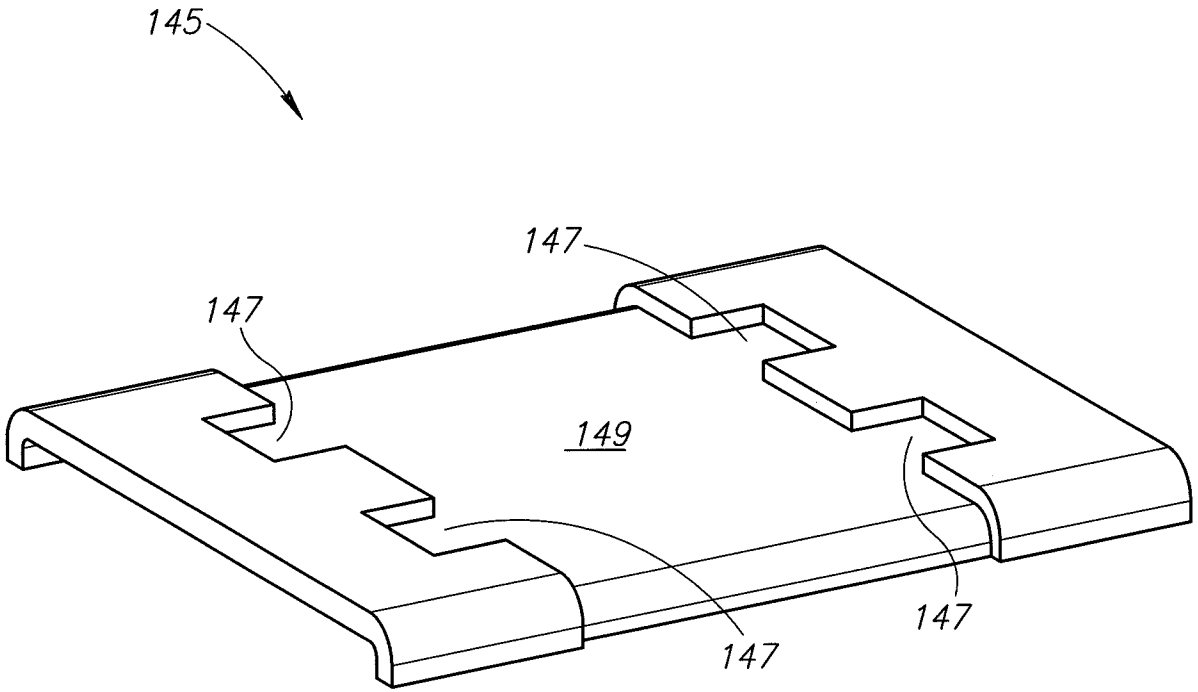
FIG. 5C shows a wrap member attachable to one of the containers of FIG. 1 according to an embodiment of the present invention.

As best shown in FIG. 5C, the surface 149 may take the form of a wrap 145 coupled to the bottom portion of container 104 (FIGS. 1 and 4). Recessed portions 147 are configured to engage the offset member 146 (FIG. 5A).

Figure 6:
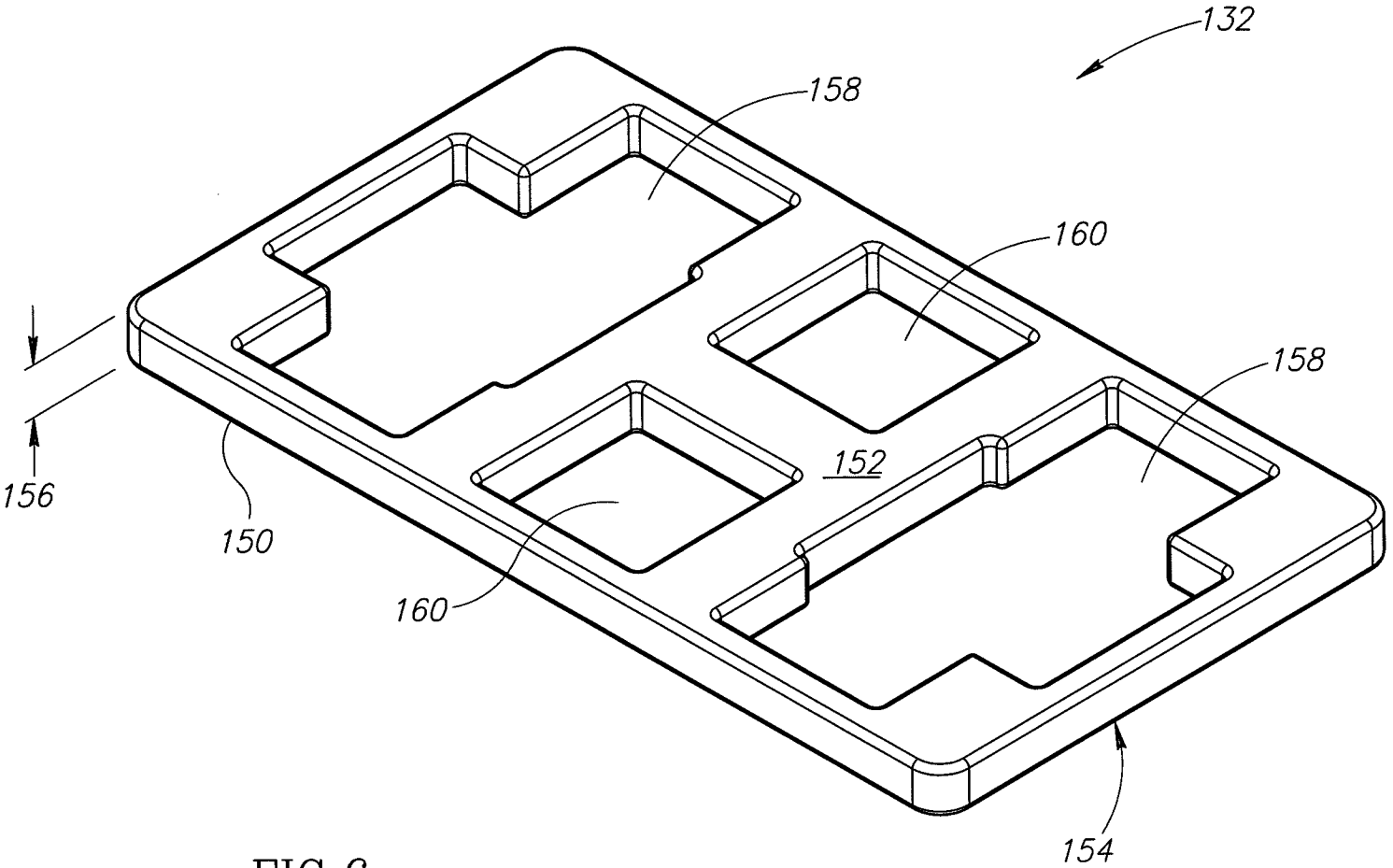
FIG. 6 shows an isometric view of a second universal member according to another embodiment of the present invention.

FIG. 6 shows the universal member 132 having the form of a plate 150 with a top side 152 and a bottom side 154 defining a thickness 156. The universal member 132 includes first openings 158 and second openings 160 arranged to complementarily receive the stacking patterns 106, 118 of the containers 102, 104, respectively. More specifically, the first openings 158 take the form of T-shaped openings having and the second openings 160 take the form of square-shaped openings located between the T-shaped openings 158.

Referring once again back to FIGS. 1 and 2, the arrangement of the openings 158, 160 in cooperation with the thickness 156 provides a complementary stacking pattern for receiving the protuberances 108 of the container 102*a* and correspondingly receiving the protuberances 120 of the container 104. By way of example, if the thickness of both types of protuberances 108, 120 is 0.40 inches, equaling a combined thickness of 0.80 inches, then it follows that the thickness 156 of the universal member 132 is at least greater than 0.80 inches.

The universal members 130, 132 may be deployed together when multiple containers with different stacking patterns are being stacked together or alternatively may be deployed independently, such as when one different-style container needs to be stacked onto one or more same-style containers. Further, the universal members may be provided in pairs. In one embodiment, the universal members may be coded or marked to provide clear instructions on which side faces up versus side faces down depending on the types of containers being stacked and in what order.

While the preferred embodiment of the invention has been illustrated and described, as noted above, many changes can be made without departing from the spirit and scope of the invention. For example, the shape and configuration of the openings and protuberances of the containers and universal members may be varied to create different stacking patterns while still providing correspondence between the containers and matching universal members. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A container stacking system for stacking containers, the container stacking system comprising:

a first stackable container having a first stacking pattern including a first upper plurality of protrusions secured to and extending from an upward facing surface of the first stackable container and a first lower plurality of protrusions secured to and extending from a downward facing surface of the first stackable container;

a second stackable container having a second stacking pattern including a second upper plurality of protrusions secured to and extending from an upward facing surface of the second stackable container and a second lower plurality of protrusions secured to and extending from a downward facing surface of the second stackable container;

a third stackable container having a third stacking pattern extending from both an upward facing surface and a downward facing surface of the third stackable container;

a first universal member located between the first and second stackable containers when the first and second stackable containers are in a stacked configuration, the first universal member having a first arrangement of openings on a first side and a second side of the first universal member configured to receive at least a portion of the first lower plurality of protrusions on the first side and at least a portion of the second upper plurality of protrusions on the second side, the first lower plurality of protrusions have a first depth and a first lateral pattern, the second upper plurality of protrusions have a second lateral pattern different than the first lateral pattern, and the thickness of the first universal member is greater than a combined height of the first lower plurality of protrusions and the second upper plurality of protrusions; and a second universal member located between the second and third stackable containers when the second and third stackable containers are in a stacked configuration, the second universal member having a second arrangement of openings configured to receive at least a portion of the second stacking pattern and at least a portion of the third stacking pattern.

2. The container stacking system of claim 1, wherein the first stacking pattern includes at least two T-shaped protuberances.

3. The container stacking system of claim 1, wherein the second stacking pattern includes at least two T-shaped protuberances.

4. The container stacking system of claim 1, wherein the first stacking pattern includes a first plurality of rectangular-shaped protuberances located adjacent to a second plurality of rectangular-shaped protuberances.

5. The container stacking system of claim 1, wherein the second stacking pattern includes a first plurality of rectangular-shaped protuberances located adjacent to a second plurality of rectangular-shaped protuberances.

6. The container stacking system of claim 1, wherein the first arrangement of openings define a perimeter shape sized to receive both the first lower plurality of protrusions and the second upper plurality of protrusions.

* * * * *